US008105122B2

(12) United States Patent
Inaba

(10) Patent No.: US 8,105,122 B2
(45) Date of Patent: Jan. 31, 2012

(54) PROPULSION DEVICE FOR A MARINE MOTOR

(75) Inventor: Takeshi Inaba, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 254 days.

(21) Appl. No.: 12/552,041

(22) Filed: Sep. 1, 2009

(65) Prior Publication Data

US 2010/0144221 A1 Jun. 10, 2010

(30) Foreign Application Priority Data

Dec. 10, 2008 (JP) ..... 2008-314461

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS

| | | | | |
|---|---|---|---|---|
| 2,117,852 | A | 5/1938 | Pearmain | |
| 2,681,632 | A | 6/1954 | Rossman | |
| 3,467,051 | A | 9/1969 | Shimanckas | |
| 3,919,964 | A | 11/1975 | Hagen | |
| 4,986,774 | A * | 1/1991 | Wantz | 440/75 |
| 6,176,750 | B1 * | 1/2001 | Alexander et al. | 440/75 |
| 7,214,111 | B1 | 5/2007 | Phillips et al. | |

FOREIGN PATENT DOCUMENTS

| | | | |
|---|---|---|---|
| JP | 49-55088 | A | 5/1974 |
| JP | 2003-205891 | A | 7/2003 |

* cited by examiner

*Primary Examiner* — Stephen Avila
(74) *Attorney, Agent, or Firm* — Arent Fox, LLP

(57) ABSTRACT

In a propulsion device for a marine motor, a shift rod (19) extends vertically in a gear case (1*a*) provided in a lower part of the marine motor, and is provided with a lower end (19*a*) cooperating with a mechanism for mechanically actuating a clutch device (18) for shifting a power transmission mechanism of the propulsion device. The lower end of the shift rod is additionally provided with a valve (37, 38) that controls feeding of hydraulic oil to an actuator (36) for assisting an effort required to turn the shift rod and actuate the clutch device. Thereby, the manual torque applied to the shift rod to turn the same to a forward and reverse position is assisted by the hydraulic actuator with a minimum modification to a purely manual arrangement for shifting the power transmission mechanism.

5 Claims, 5 Drawing Sheets

40a
19a
37b
38b
38a
37a
36c
36
36a
36b
34
35
19
41
32a
37c
38c
21
32
40b
26
6a
S2
28b
42
44
23b
G2
27b
31b
31
18
20c
31a
27a
G1
17
23a
33
22
25
S1
20a
24
28a
1a
20

PROPULSION DEVICE FOR A MARINE MOTOR

CROSS-REFERENCE TO RELATED APPLICATION

This application claims the priority of Japanese Application No. 2008-314461, filed Dec. 10, 2008, the entire specification, claims and drawings of which are incorporated herewith by reference.

TECHNICAL FIELD

The present invention relates to a propulsion device for a marine motor that can be shifted to a forward, reverse and neutral condition as desired by operating a shift member such as a shift rod. The marine motor may consist of an outboard or inboard marine motor.

BACKGROUND OF THE INVENTION

A propulsion device for a marine motor is often incorporated with a clutch mechanism that can be shifted to a forward, reverse and neutral condition as desired. A typical propulsion device for an outboard marine motor includes a drive shaft extending vertically and connected to a crankshaft of an internal combustion engine at an upper end, a drive bevel gear fixedly attached to a lower end of the drive shaft, a propeller shaft extending horizontally adjacent to the lower end of the drive shaft, a pair of driven bevel gears supported coaxially to the propeller shaft in a freely rotatable manner and meshing with the drive bevel gear so as to rotate in mutually opposite directions and a pair of clutch devices that engage a selected one of the driven bevel gears with the propeller shaft. See Japanese patent laid open publication No. 2003-205891 (Patent Document 1), for instance.

The clutch devices disclosed in Patent Document 1 each consist of a multi-disk clutch device which is relatively complex and occupies a relatively large space. Furthermore, each clutch device is actuated by hydraulic pressure, and this requires an oil circuit for each clutch device. These factors result in a highly level of complexity and an excessive space requirement. A high manufacturing cost is also a problem.

Propulsion devices using manually operated dog clutches for shifting a power transmission mechanism is also known, but a large manual force is required for its operation, and this impairs the convenience of the outboard marine motor.

BRIEF SUMMARY OF THE INVENTION

In view of such problems of the prior art, a primary object of the present invention is to provide a propulsion device for a marine motor that allows shifting of a power transmission mechanism thereof without requiring a large manual force for its operation.

A second object of the present invention is to provide a propulsion device for a marine motor fitted with a power assist arrangement for shifting of a power transmission mechanism which is compact and simple in structure.

A third object of the present invention is to provide a propulsion device for a marine motor fitted with a power assist arrangement for shifting of a power transmission mechanism which is economical to manufacture.

According to the present invention, such an object can be accomplished by providing a propulsion device for a marine motor, comprising: a gear case provided in a lower part of the marine motor and receiving a propeller shaft extending substantially horizontally therein; a drive shaft passed vertically in the gear case and having an upper end connected to a crankshaft of an engine in a torque transmitting relationship and a lower end received in the gear case and fitted with a drive bevel gear; a pair of driven bevel gears supported by the gear case in a freely rotatable manner around an axial line of the propeller shaft and meshing with the drive bevel gear from mutually opposite directions; a clutch member engaged rotationally fast and axially slidably by the propeller shaft, and provided with engagement teeth configured to engage one of the driven bevel gears at a first axial position and the other driven bevel gear at a second axial position; a hydraulic actuator defining two chambers and having an output member that is actuated in a desired direction depending on which of the two chambers hydraulic pressure is supplied, the output member being connected to the clutch member via a force transmitting member in such a manner that the clutch member may be selectively actuated to each of the first and second axial positions; a shift member engaging the force transmitting member in such a manner that a movement of the shift member causes the clutch member to be selectively actuated to each of the first and second axial positions; a hydraulic source; and a valve provided in association with the shift member so that hydraulic fluid from the hydraulic source is supplied to a selected one of the two chambers depending on a direction of a movement of the shift member so that the hydraulic actuator provides an assisting force for an actuation of the clutch member in a direction to assist an effort to actuate the clutch member by using the shift member.

Thus, a manual effort applied to the shift member to shift the position of the clutch member to selectively drive the propeller shaft in a forward or reverse direction is favorably assisted by the hydraulic actuator, and this can be accomplished by a minor addition to a purely manual arrangement.

Typically, the power transmitting member comprises a rack member formed with a rack and the shift member includes a pinion meshing with the rack. In particular, the shift member may comprise a shift rod extending vertically in the gear case, and the valve may comprise a passage formed in the shift rod and cooperating passages formed in a wall of the gear case closely surrounding the shift rod.

According to a particularly preferred embodiment of the present invention, the hydraulic actuator comprises a cylinder formed in a wall of the gear case and a piston received in the cylinder, the output member including a piston rod connected to the piston and extending out of the cylinder in a sealed relationship. Also, the clutch member comprises a sleeve member formed with a crown gear on each axial end, and each driven bevel gear is provided with a crown gear configured to cooperate with the crown gear on the corresponding axial end of the sleeve member.

If the hydraulic source comprises an oil pump for feeding lubricating oil to the engine of the marine motor, the need for a separate hydraulic source such as a separate pump is eliminated, and this significantly contributes to the simplification and economization of the design. Also, circulating engine lubricating oil in a lower part of a marine motor promotes the cooling of the oil, and this is beneficial in maintaining a high lubricating performance for the engine.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
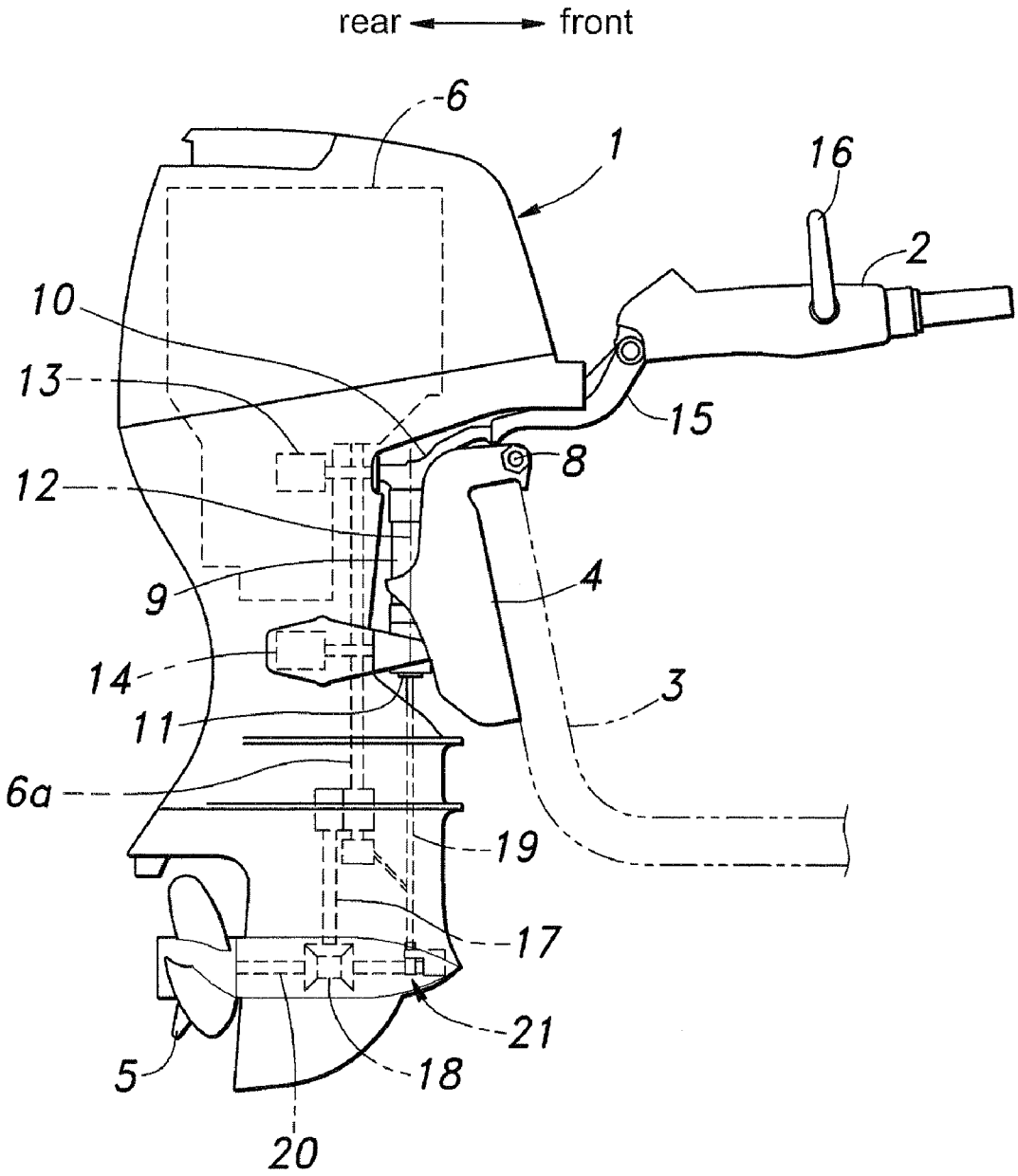
FIG. 1 is a side view of an outboard marine motor embodying the present invention.

Referring to FIG. 1, an outboard marine motor embodying the present invention comprises a marine motor main body 1, a tiller handle 2 integrally attached to the main body 1 and a mounting bracket 4 also attached to the main body 1 for securing the main body to a part of a boat 3 such as a transom board. The main body 1 further comprises a propulsion propeller 5 provided in a lower part thereof and an internal combustion engine 6 for driving the propeller 5 provided in an upper part thereof.

To the mounting bracket 4 is connected a swivel case 9 via a laterally extending tilt pin 8 so that the swivel case 9 along with the main body 1 may be tilted up and down with respect to the boat 3 as required. The swivel case 9 is integrally formed with a tube that receives a swivel shaft (not shown in the drawings) extending vertically. Numeral 12 denotes an axial line of the swivel shaft. The swivel shaft is attached to a mount frame 10 which is a part of the main body 1 at an upper end thereof and to a lower mount housing 11 which is also a part of the main body 1 at a lower end thereof. The mount frame 10 and lower mount housing 11 jointly support the main body 1 via vibration isolation devices 13 and 14, respectively.

The tiller handle 2 is attached to the mount frame 10 via a bracket 15. Therefore, the main body 1 can be steered around the central axial line 12 of the swivel shaft by moving the tiller handle 2 in a corresponding lateral direction. The tiller handle 2 is fitted with a shift lever 16.

In the illustrated embodiment, the internal combustion engine 6 is provided with a vertically oriented crankshaft 6*a*, and a drive shaft 17 extending in parallel with the crankshaft 6*a* has an upper end which is coupled with the crankshaft 6*a* via gears in a power transmitting relationship. The lower end of the drive shaft 17 is connected to a propeller shaft 20 coaxially carrying the propeller 5 via a power transmission device including a clutch device 18. The propeller shaft 20 extends in a fore-and-aft direction of the outboard motor and hence extends perpendicularly to the drive shaft 17.

The shift lever 16 is connected to a shift rod 19 (via a wire or other remote control arrangement which is not shown in the drawings) which extends vertically downward to a rack and pinion mechanism 21 provided adjacent to the front end of the propeller shaft 20. By tilting the shift lever 16 forward and backward from a neutral upright position, the shift rod 19 is turned in corresponding directions around a central axial line thereof, and this in turn actuates the clutch device 18 via the rack and pinion mechanism 21 as will be described hereinafter.

The clutch device 18 and rack and pinion mechanism 21 are received in a gear case 1*a* disposed in a lower part of the main body 1. The internal structure of the gear case 1*a* is described in the following with reference to FIG. 2.

A drive bevel gear 22 is fixedly attached to the lower end of the drive shaft 17, and meshes with a pair of driven bevel gears 23*a* and 23*b* each disposed coaxially and freely rotatable with respect to the propeller shaft 20. One of the driven bevel gears 23*a* is rotatably supported by a bearing holder 24 (which is fixedly attached to the gear case 1*a*) via a roller bearing 25, and the other driven bevel gear 23*b* is likewise rotatably supported by the gear case 1*a* via a ball bearing 26.

The driven bevel gear 23*a* located to the rear of the drive bevel gear 22 includes a gear portion G1 formed with teeth and a stem portion S1 having a relatively small diameter and extending coaxially and rearward from the gear portion G1. A crown gear 27*a* is formed in a radially inner part of the gear portion G1 of the driven bevel gear 23*a*. The stem portion S1 is received in an inner race of the roller bearing 25. The roller bearing 25 is axially retained by a radial flange 20*a* formed in the propeller shaft 20 and a radial flange formed in the bearing holder 24.

The driven bevel gear 23*b* located to the front of the drive bevel gear 22 includes a gear portion G2 formed with teeth and a stem portion S2 having a relatively small diameter and extending coaxially and forward from the gear portion G2. A crown gear 27*b* is formed in a radially inner part of the gear portion G2 of the driven bevel gear 23*b*. The stem portion S2 is received in an inner race of the ball bearing 26. The ball bearing 26 is axially retained between annular shoulders defined by the bevel gear 23*b* and gear case 1*a*.

The bearing holder 24 is formed as a hollow cylindrical member having an inner end fitted into a complementary opening in the gear case 1*a* via a O-ring and an outer end fixedly attached to a rear end part of the gear case 1*a* by threaded bolts. The driven bevel gears 23*a* and 23*b* are each formed with a coaxial bore extending through the entire axial length thereof. The propeller shaft 20 is received in the bearing holder 24, and is passed into the central bores of the driven bevel gears 23*a* and 23*b*. The propeller shaft 20 is rotatably supported by the bearing holder 24 and stem portion S2 of the front driven bevel gear 23*b* via needle bearings 28*a* and 28*b*.

A clutch member 31 consisting of a cylindrical sleeve member is fitted on a part of the propeller shaft 20 located between the two driven bevel gears 23*a* and 23*b* in an axially slidable manner. This part of the propeller shaft 20 is formed with a slot 20*c* extending axially by a certain length and entirely across a diameter thereof. A pin 33 that passes through this slot 20*c* is pressed fitted into holes formed diametrically across the clutch member 31 so that the clutch member 31 can move axially with respect to the propeller shaft 20 by a certain stroke, but is rotationally fast with respect to the propeller shaft 20.

Figure 2:
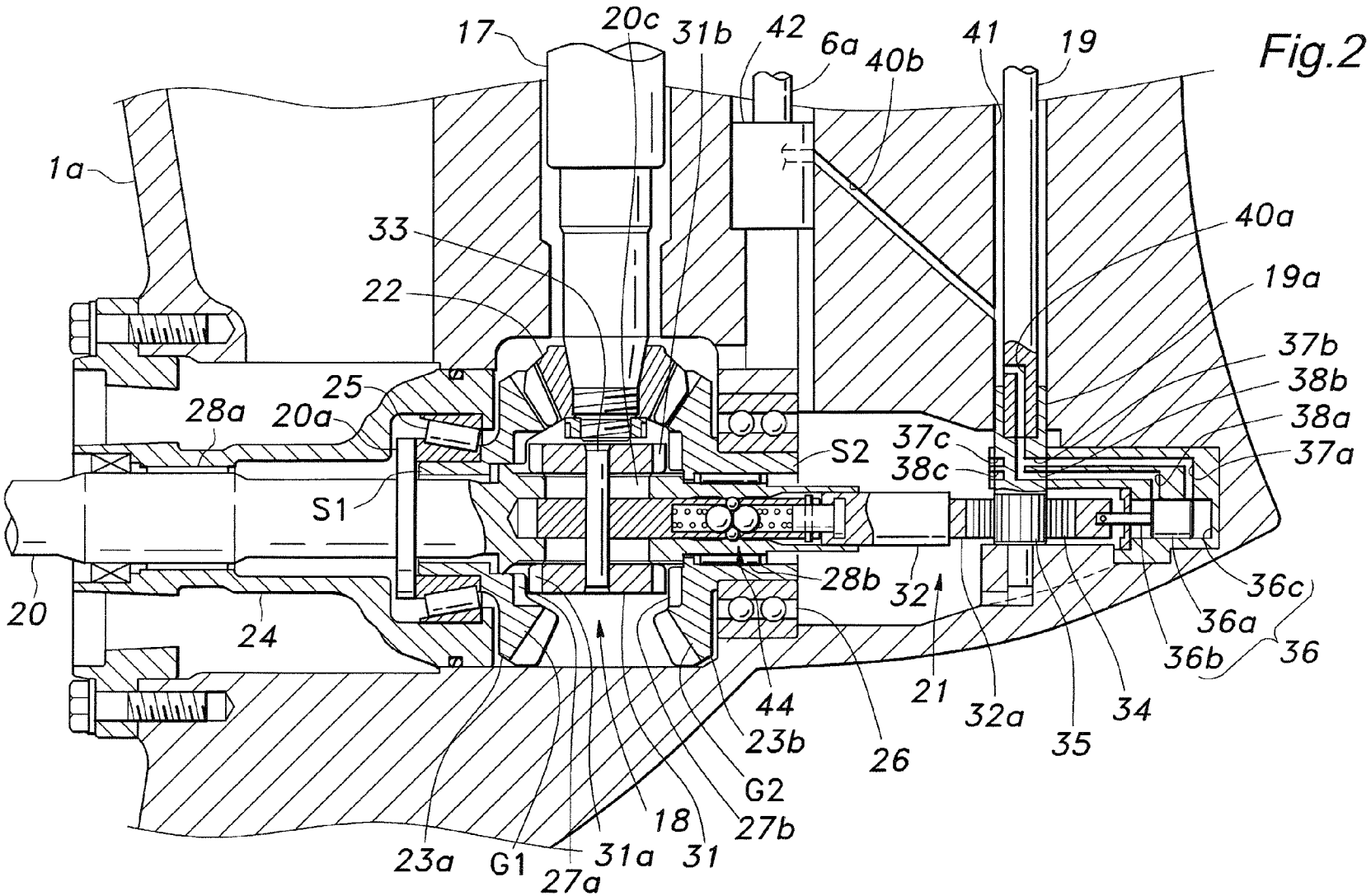
FIG. 2 is a fragmentary sectional view of a power transmission mechanism of a propulsion device of the marine motor.
Figure 3A:
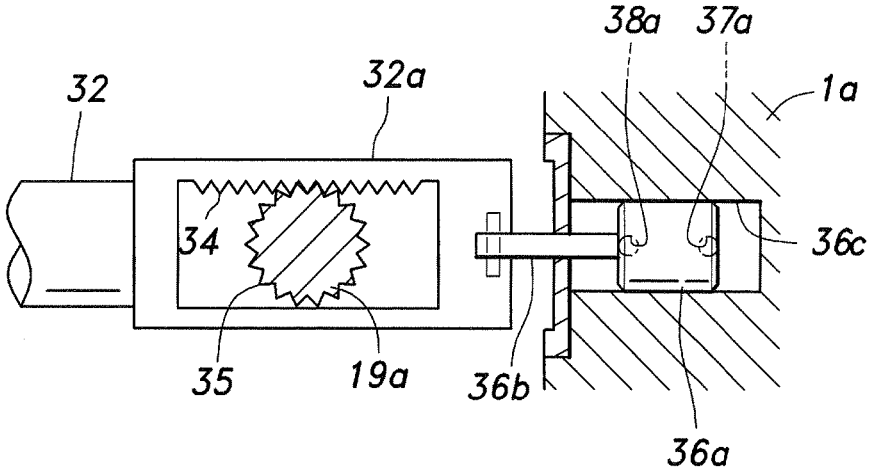
FIG. 3*a* is a schematic view of a hydraulic actuator for a clutch mechanism according to the present invention in a neutral condition.
Figure 3B:
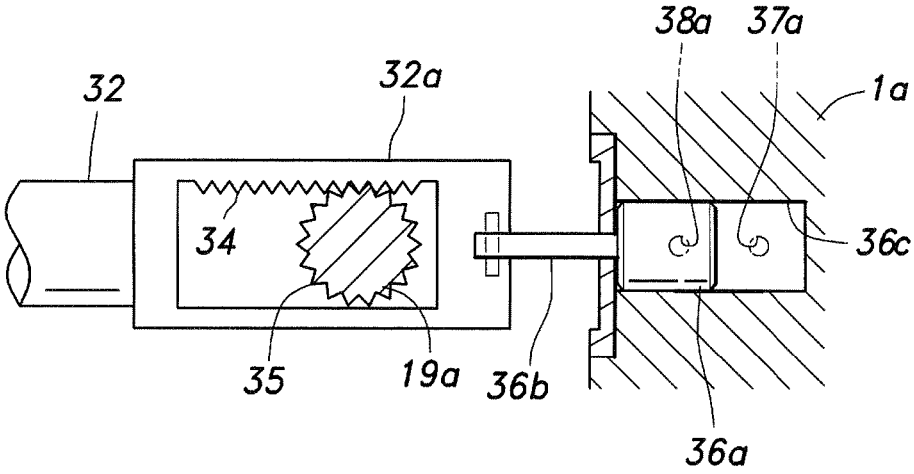
FIG. 3*b* is a view similar to FIG. 3*a* showing the hydraulic actuator in a forward condition.
Figure 3C:
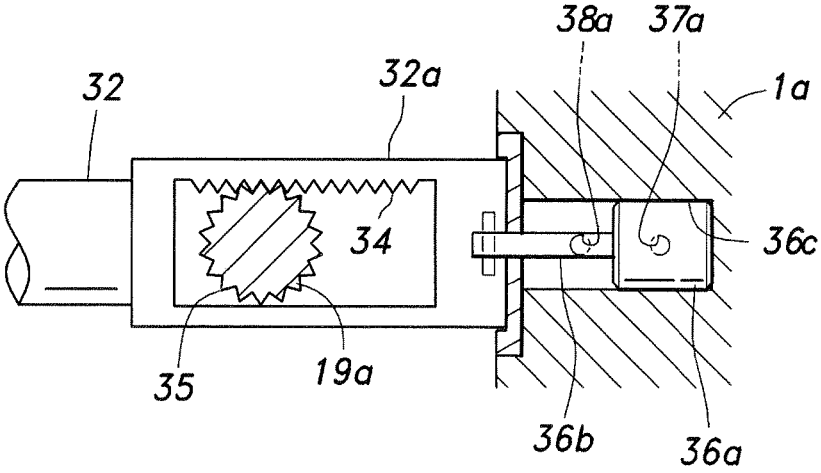
FIG. 3*c* is a view similar to FIG. 3*a* showing the hydraulic actuator in a reverse condition.

A forward end portion of the propeller shaft 20 is formed with a coaxial central bore that receives a rear part of a slide rod 32 which includes two members are connected in tandem. The rear end (left hand side as seen in FIG. 2) of the slide rod 32 is connected to the pin 33 so that the clutch member 31 and slide rod 32 are configured to jointly move in the axial direction. The front end of the slide rod 32 is connected to a rack member 32*a* extending in the axial direction. As shown in FIGS. 3*a* to 3*c*, the rack member 32*a* has a rectangular cross section and is provided with an axial slot extending vertically through the rack member 32*a*. A rack 34 is formed in one of the inner walls of the rack member 32*a* facing the axial slot, and meshes with a pinion 35 provided in the lower end of the shift rod 19 in a coaxial relationship. In the illustrated embodiment, the pinion 35 is formed in a cap member 19*a* fixedly fitted on the lower end of the shift rod 19.

FIG. 3*a* illustrates a neutral condition in which the pinion 35 is located in a central part of the rack 34. At this time, as shown in FIG. 2 which also illustrates the neutral condition, the clutch member 31 is located in a central position where neither of the crown gears 31*a* or 31*b* meshes with the corresponding crown gear 27*a* or 27*b*.

The front end of the rack member 32*a* is connected to a piston rod 36*b* which is in turn integrally connected to a piston 36*a* of a hydraulic actuator 32*a*. The piston 36*a* is received in a cylinder 36*c* of the hydraulic actuator 36 which is formed in the front wall of the gear case 1*a*. In the neutral condition illustrated in FIG. 2 and FIG. 3*a*, a forward oil feed passage 37*a* communicates with a front chamber of the cylinder 36 defined by the front face of the piston 36*a*, and a reverse oil feed passage 38*a* communicates with a rear chamber of the cylinder 36 defined by the rear face of the piston 36*a*.

Referring to FIG. 2, the two oil feed passages 37*a* and 38*a* are passed through the gear case 1*a* and open out, via axially spaced ports, into a hole 41 passed vertically in the wall of the gear case 1*a* so as to closely receive the cap member 19*a*. An oil pump 42 is provided in the gear case 1*a*, and is functionally connected to an end of the crankshaft 6*a*. The oil pump 42 may consist of a pump for feeding lubricating oil to various parts of the engine. The outlet end of the oil pump 42 communicates with the hole 41 via a communication passage 40*b* formed in the wall of the gear case 1*a*. The shift rod 19 is formed with an internal oil passage 40*a* which extend axially therein, and communicates, at an upper end thereof, with the communication passage 40*b* via a radial passage formed in the shift rod 19 and the annular space defined between the shift rod 19 and surrounding wall of the hole 41. The lower end of the internal oil passage 40*a* communicates with a pair of radial passages 37*b* and 38*b* formed in the shift rod 19 at an axially and angularly spaced relationship. The axial spacing between the radial passages 37*b* and 38*b* corresponds to the axial spacing between the ports of the two oil feed passages 37*a* and 37*a* in the hole 41.

As best illustrated in FIGS. 4*a* to 4*e*, the cap member 19*a* is formed with a pair of circumferential grooves 37*c* and 38*c* located at axial positions corresponding to the ports of the feed passages 37*a* and 37*a*, respectively, and extending over prescribed angular ranges. The part of the wall of the hole 41 diametrically opposing the ports of the feed passages 37*a* and 37*a* is provided with a relief opening 43 communicating with the interior of the gear case 1*a*. Therefore, depending on the angular position of the shift rod 19, one of the chambers of the hydraulic actuator 36 can be communicated with the interior of the gear case 1*a* via corresponding one of the circumferential grooves 37*c* and 38*c* and the relief opening 43 to enable the oil in the corresponding chamber may be expelled without encountering any back pressure.

A middle part of the slide rod 32 is provided with a detent mechanism 33 using steel balls and compression coil springs so that the position of the slide rod 32 may be known to an operator of the marine motor operating the shift lever 12 via a tactile sensation transmitted via the shift rod 19, as well as providing a retaining force for the slide rod 32 at prescribed positions such as the neutral position. The drive shaft 17 is connected to the crankshaft 6*a* via gears, and rotates at all times when the engine 6 is running. Likewise, the two driven bevel gears 23*a* and 23*b* meshing with the drive bevel fear 22 of the drive shaft 17 rotate in mutually opposite directions at all times when the engine 6 is running.

The power transmission mechanism of the illustrated embodiment can be shifted to a forward and reverse condition by turning the shift rod 19 clockwise and counter clockwise, as seen from above, respectively. When the cap member 19*a* is turned in clockwise direction as indicated by arrow A from the position illustrated in FIG. 3*a* to the position illustrated in FIG. 3*b*, the slide rod 32 along with the rack 32*a* moves rearward, and causes the rear crown gear 31*a* of the clutch member 31 to come into engagement with the rear driven bevel gear 23*a*. Thereby, the torque of the drive shaft 17 is transmitted to the propeller shaft 29 in such a manner that the propeller 5 is turned in the direction to produce a forward propelling force.

Figure 4A:
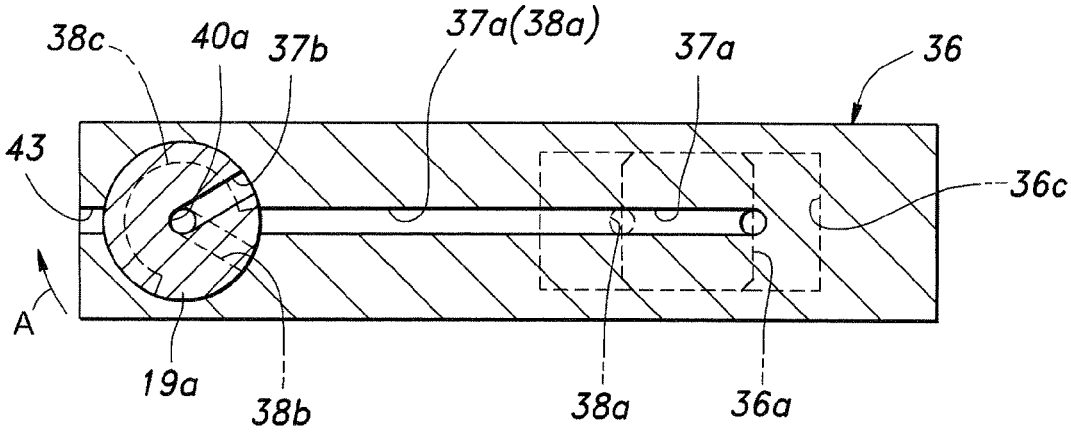
FIG. 4*a* is a fragmentary sectional view showing a structure associated with a shift rod in the neutral condition.
Figure 4B:
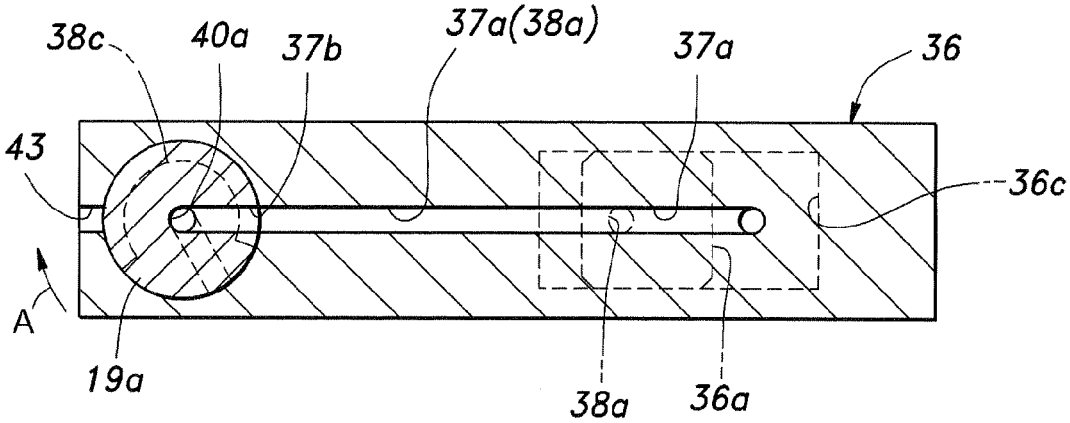
FIG. 4*b* is a view similar to FIG. 4*a* showing the same structure in a forward assist condition.
Figure 4C:
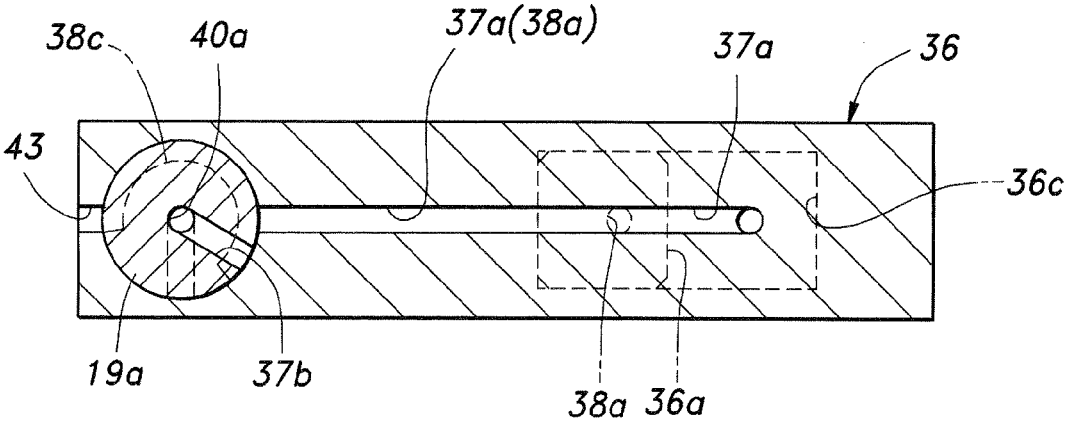
FIG. 4*c* is a view similar to FIG. 4*a* showing the same structure in a forward retaining condition.

As the shift rod 19 is turned in clockwise direction as discussed above, the cap member 19*a* also turns from the position indicated in FIG. 4*a*, to the position indicated in FIG. 4*b* and then to the position indicated in FIG. 4*c*. (In FIGS. 4*a* to 4*c*, the circumferential groove 37*c* is omitted from illustration to avoid the crowding of the drawings as it performs no function in the illustrated conditions.) In the position indicated in FIG. 4*b*, the forward radial passage 37 communicates with the forward feed passage 37*a* so that the hydraulic oil is supplied to the front chamber of the hydraulic actuator 36. At this time, the reverse feed passage 38*a* is communicated with the relief opening 43 via the circumferential groove 38*c* so that the rear chamber of the actuator 36 is essentially free from back pressure or communicates with the atmosphere.

Therefore, the piston 36*a* is subjected to a rearward force that assists the effort to turn the shift rod 19 in clockwise direction, and this reduces the effort required for turning the shift rod 19. In particular, when axially sliding the clutch member 31 along the propeller shaft 20 so as to cause the crown gears 27*a* and 31*a* to mesh with each other, a significant torque is required to turn the shift rod 19 when no assisting force is available. However, according to the illustrated embodiment, with the assisting force of the hydraulic actuator 36, the effort required to turn the shift rod 19 can be minimized.

In this connection, the slide rod 32 may be incorporated with a small play that allows hydraulic pressure to be supplied to the hydraulic actuator 36 with a slight turning of the shift rod 19 that does not invoke any significant reaction force. Alternatively, the slide rod 32 may be substantially free from play so that hydraulic pressure may be supplied to the hydraulic actuator 36 only when the shift rod is turned to such an angular position as to oppose a significant reaction force. Similarly, by configuring the valve formed by the cap member 19*a* and associated passages in an appropriate manner, the manual effort required to invoke the hydraulic assisting force of the actuator 36 can be selected as desired.

When the shift rod 19 is turned further to the position illustrated in FIG. 4*c*, the detent mechanism 44 provides a retaining force for the slide rod 32 and, hence, shift rod 19 to be held at that position. At the same time, the front chamber of the hydraulic actuator 36 is kept filled with the hydraulic oil, and this is effective in retaining the shift rod 32 at the forward shift position even when no manual effort is applied to the shift rod 19.

By turning the shift rod 19 in counter clockwise direction from this position until the forward feed passage 37*a* communicates with the circumferential passage 37*c* that in turn communicates with the relief opening 43, the hydraulic oil is allowed to be removed from the front chamber of the hydraulic actuator 36, and this puts the transmitting mechanism back into the original neutral position.

Figure 4D:
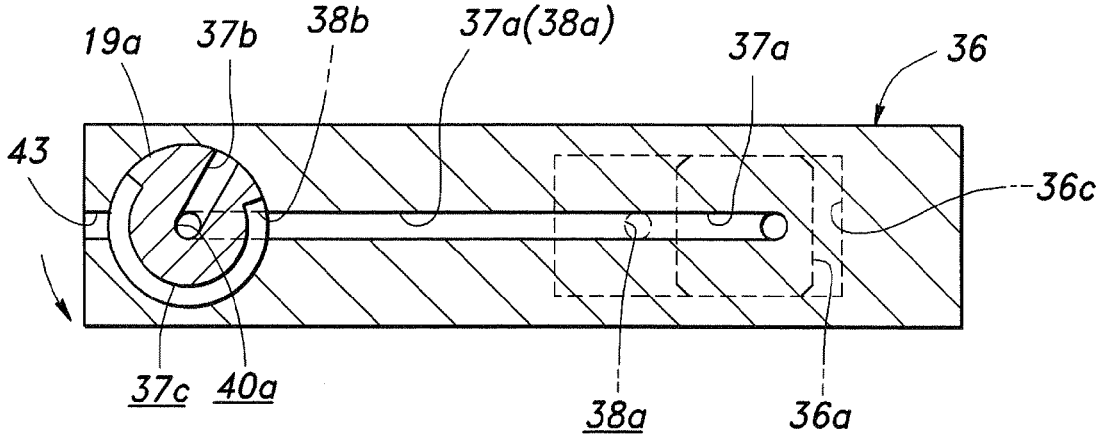
FIG. 4*d* is a view similar to FIG. 4*a* showing the same structure in a reverse assist condition.
Figure 4E:
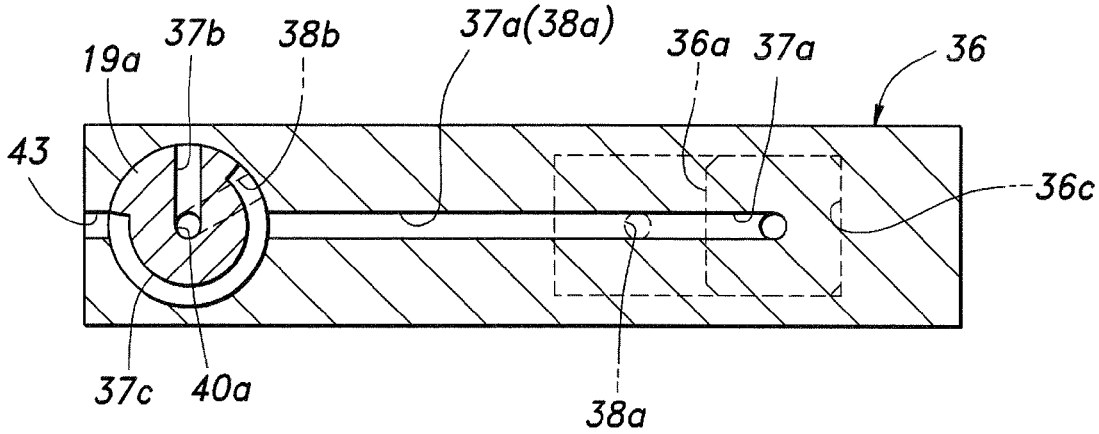
FIG. 4*e* is a view similar to FIG. 4*a* showing the same structure in a reverse retaining condition.

Conversely, when the shift rod 19 is turned in counter clockwise direction from the position indicated in FIG. 4*a*, to the position indicated in FIG. 4*d* and then to the position indicated in FIG. 4*e*. (In FIGS. 4*d* and 4*e*, the circumferential groove 37*b* is omitted from illustration to avoid the crowding of the drawings as it performs no function in the illustrated conditions.) In the position indicated in FIG. 4*e*, the reverse radial passage 38*b* communicates with the reverse feed passage 38*a* so that the hydraulic oil is supplied to the rear chamber of the hydraulic actuator 36. At this time, the forward feed passage 37*a* is communicated with the relief opening 43 via the circumferential groove 37*c* so that the front chamber of the actuator 36 is essentially free from back pressure or communicates with the atmosphere.

Therefore, the piston 36*a* is subjected to a forward force that assists the effort to turn the shift rod 19 in counter clockwise direction, and this reduces the effort required for turning the shift rod 19. When the shift rod 19 is turned further to the position illustrated in FIG. 4*e*, the detent mechanism 44 provides a retaining force for the slide rod 32 and, hence, shift rod 19 to be held at that position. At the same time, the rear chamber of the hydraulic actuator 36 is kept filled with the hydraulic oil, and this is effective in retaining the shift rod 32 at the reverse shift position even when no manual effort is applied to the shift rod 19.

In the illustrated embodiment, the cylinder 36*c* of the hydraulic actuator 36 is formed in the wall of the gear case 1*a*, and various components of the valve for selectively feeding hydraulic oil to the hydraulic actuator are formed in the shift rod and the surrounding part of the wall of the gear case. Therefore, a hydraulic actuator and associated hydraulic circuit can be formed in the gear case with a minimum modification to existing purely manual shift arrangement. Therefore, it is possible to provide a basically same marine motor both as a power assisted tiller model and as a manually operated tiller model interchangeably. Using an existing oil pump for lubricating the engine also for providing hydraulic oil for the hydraulic actuator for the clutch mechanism also contributes to the simplicity and compactness of the design, and minimizes the cost.

Although the present invention has been described in terms of a preferred embodiment thereof, it is obvious to a person skilled in the art that various alterations and modifications are possible without departing from the scope of the present invention which is set forth in the appended claims.

The contents of the original Japanese patent application on which the Paris Convention priority claim is made for the present application are incorporated in this application by reference.

The invention claimed is:

1. A propulsion device for a marine motor, comprising:

a gear case provided in a lower part of the marine motor and receiving a propeller shaft extending substantially horizontally therein;

a drive shaft passed vertically in the gear case and having an upper end connected to a crankshaft of an engine in a torque transmitting relationship and a lower end received in the gear case and fitted with a drive bevel gear;

a pair of driven bevel gears supported by the gear case in a freely rotatable manner around an axial line of the propeller shaft and meshing with the drive bevel gear from mutually opposite directions;

a clutch member engaged rotationally fast and axially slidably by the propeller shaft, and provided with engagement teeth configured to engage one of the driven bevel gears at a first axial position and the other driven bevel gear at a second axial position;

a hydraulic actuator defining two chambers and having an output member that is actuated in a desired direction depending on which of the two chambers hydraulic pressure is supplied, the output member being connected to the clutch member via a force transmitting member in such a manner that the clutch member may be selectively actuated to each of the first and second axial positions;

a shift member engaging the force transmitting member in such a manner that a movement of the shift member causes the clutch member to be selectively actuated to each of the first and second axial positions;

a hydraulic source; and a valve provided in association with the shift member so that hydraulic fluid from the hydraulic source is supplied to a selected one of the two chambers depending on a direction of a movement of the shift member so that the hydraulic actuator provides an assisting force for an actuation of the clutch member in a direction to assist an effort to actuate the clutch member by using the shift member, wherein the force transmitting member comprises a slide rod and a rack member, the slide rod having a rear end coaxially connected to a front end of the propeller shaft and the rack member extends forward in the axial direction from the front end of the slide rod and is formed with a rack, and wherein the shift member comprises a shift rod extending vertically in the gear case and is fitted with a pinion in a lower end thereof which meshes with the rack, the valve being configured as a rotary valve which is actuated by an angular movement of the shift rod.

2. The propulsion device for a marine motor according to claim 1, wherein the valve comprises a passage formed in the shift rod and cooperating passages formed in a wall of the gear case closely surrounding the shift rod.

3. The propulsion device for a marine motor according to claim 1, wherein the hydraulic actuator comprises a cylinder formed in a wall of the gear case and a piston received in the cylinder, the output member including a piston rod connected to the piston and extending out of the cylinder in a sealed relationship.

4. The propulsion device for a marine motor according to claim 1, wherein the clutch member comprises a sleeve member formed with a crown gear on each axial end, and each driven bevel gear is provided with a crown gear configured to cooperate with the crown gear on the corresponding axial end of the sleeve member.

5. The propulsion device for a marine motor according to claim 1, wherein the hydraulic source comprises an oil pump for feeding lubricating oil to the engine of the marine motor.

* * * * *